United States Patent [19]

Harfst

[11] Patent Number: 4,813,323

[45] Date of Patent: Mar. 21, 1989

[54] CHAIN LINK WITH FOLDED OVER CONNECTING PORTIONS

[75] Inventor: Michael D. Harfst, Milwaukie, Oreg.

[73] Assignee: Blount, Inc., Del.

[21] Appl. No.: 86,640

[22] Filed: Aug. 18, 1987

[51] Int. Cl.[4] ..... B27B 33/14

[52] U.S. Cl. ..... 83/830; 83/831; 83/834

[58] Field of Search ..... 83/830, 831, 832, 833, 83/834

[56] References Cited

U.S. PATENT DOCUMENTS

| | | | |
|---|---|---|---|
| 2,736,352 | 2/1956 | Wright | 83/834 X |
| 2,891,586 | 6/1959 | Wright . | |
| 4,095,490 | 6/1978 | Atkinson . | |
| 4,387,615 | 6/1983 | Lemery . | |
| 4,606,253 | 8/1986 | Weigel | 83/830 |

FOREIGN PATENT DOCUMENTS

| | | | |
|---|---|---|---|
| 690479 | 7/1964 | Canada | 83/830 |
| 2801162 | 7/1979 | Fed. Rep. of Germany | 83/830 |
| 1222866 | 1/1960 | France | 83/830 |
| 1426781 | 12/1965 | France | 83/830 |
| 24872 | 3/1963 | German Democratic Rep. . | |

*Primary Examiner*—Frank T. Yost
*Assistant Examiner*—Eugenia A. Jones
*Attorney, Agent, or Firm*—Klarquist, Sparkman, Campbell, Leigh & Whinston

[57] ABSTRACT

A link for a chain has a first planar portion and a second portion integral with and disposed adjacent the first portion, the second portion being folded over to form a bight having a pair of parallel, laterally-spaced opposed walls defining a space therebetween and adapted to receive a first portion of an adjacent link.

3 Claims, 2 Drawing Sheets

25
22
20
32
14
28
30
42
50
15
43
64
66
20
16
26
14a
18
32
43
28
34
30
52
54
50
52
56
66
68
16
43
64
18
26
34
54
70
74
68
25

20
14
22
32
28
36
38
16
26
30
34
24

20
14
30
28
32
22
42
26
40
16
34
18

20
30
32
28
38
14
34
36
16
18

20
32
28
30
14
42
38
40
36
16
18
34

14
36
40
20
28
34
42
40
16
18

CHAIN LINK WITH FOLDED OVER CONNECTING PORTIONS

BACKGROUND OF THE INVENTION

This invention relates to chains and the links thereof, and more particularly, to chains for use with chain saws.

A chain for a chain saw typically includes center mounted drive links and a plurality of side links, some of the side links serving merely as tie straps, while others incorporate right-hand and left-hand cutters. The links are of different configurations and require many different manufacturing operations in their construction. It is advantageous to reduce the number of types of links in a chain.

Accordingly, it is a principal object of the present invention to provide a form of link for a chain which can serve as the only type of link in the chain or which alternatively, can be used as one element in a chain that has a lesser number of different links than has heretofore been known.

It is a further object of the present invention to provide a chain with fewer articulated joints between links than have been required heretofore, thereby to render the chain more stable during operation.

It is a further object of the present invention to provide such a link for a chain that can run on a standard chain saw guide bar.

DESCRIPTION OF THE PREFERRED EMBODIMENT

Figure 1:
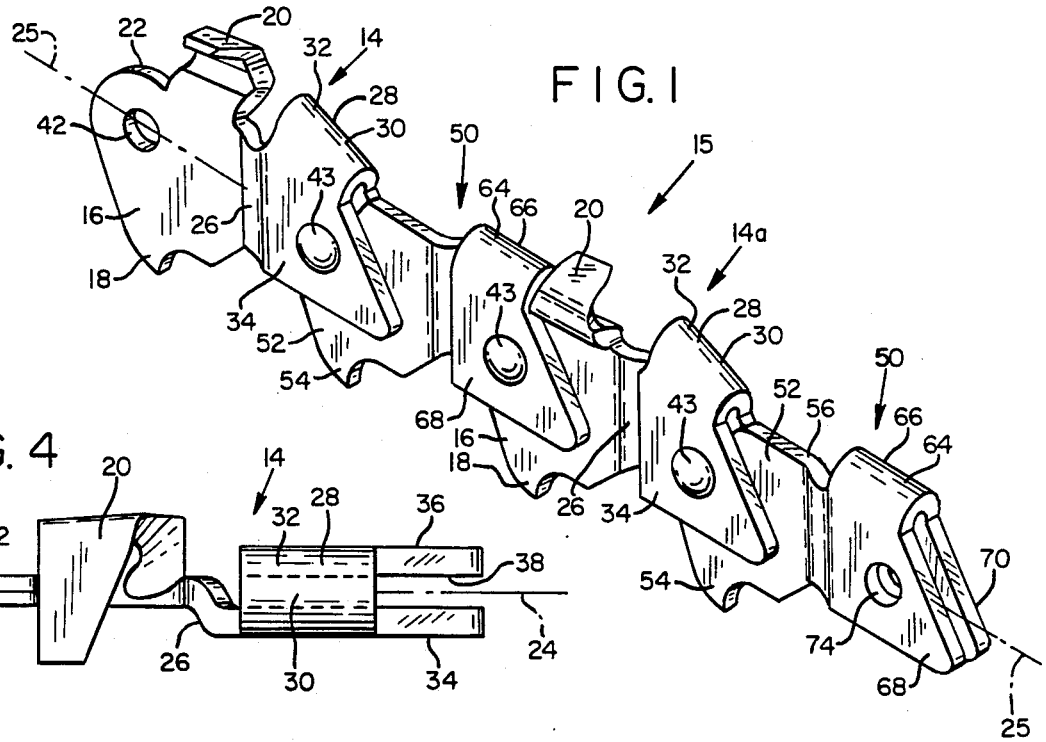
FIG. 1 is a perspective view of a chain assembly incorporating links according to the present invention.
Figure 4:
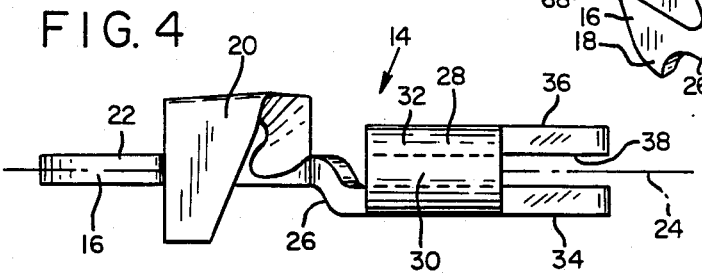
FIG. 4 is a top plan view of the chain link of FIG. 2.
Figure 3:
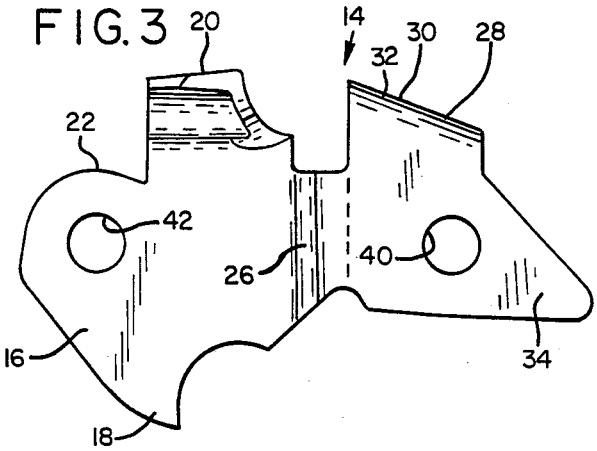
FIG. 3 is a side elevational view of the chain link of FIG. 2.
Figure 5:
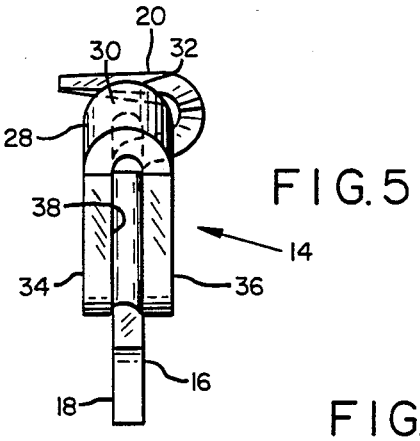
FIG. 5 is a front end view of the chain link of FIG. 2.
Figure 2:
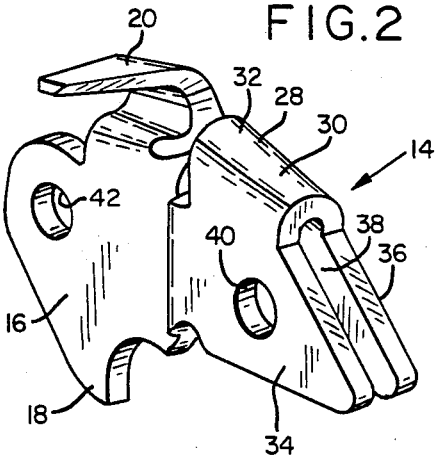
FIG. 2 is a perspective view of a chain link according to the present invention.
Figure 6:
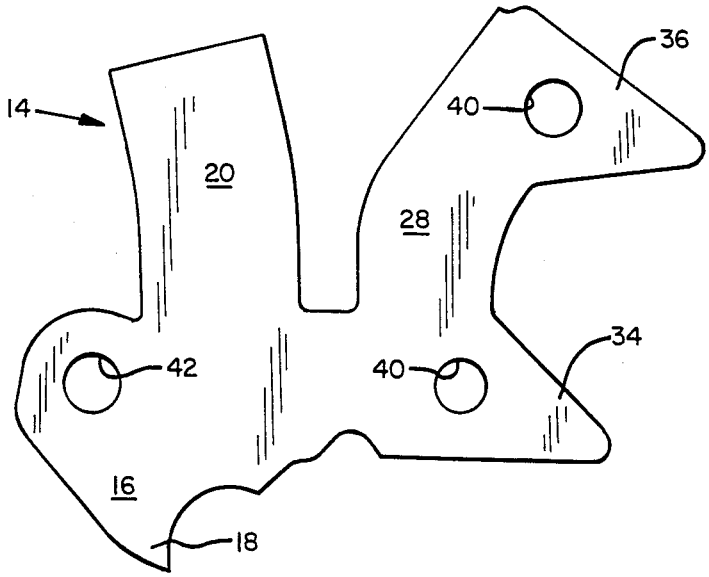
FIG. 6 is a developed pattern from which the chain link of FIG. 2 can be fabricated.
Figure 7:
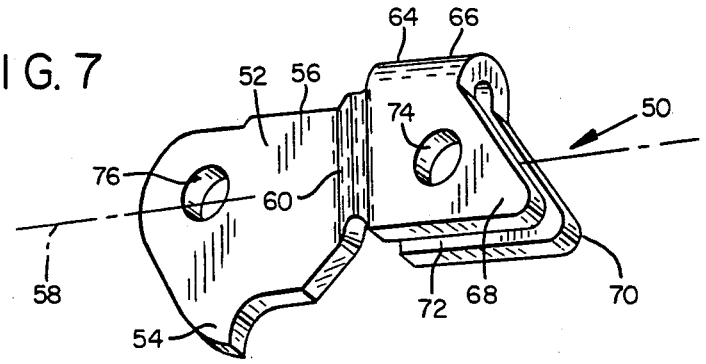
FIG. 7 is a perspective view of another embodiment of chain link according to the present invention.
Figure 9:
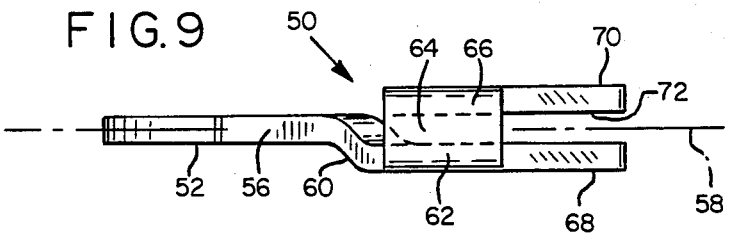
FIG. 9 is a top plan view of the chain link of FIG. 7.
Figure 8:
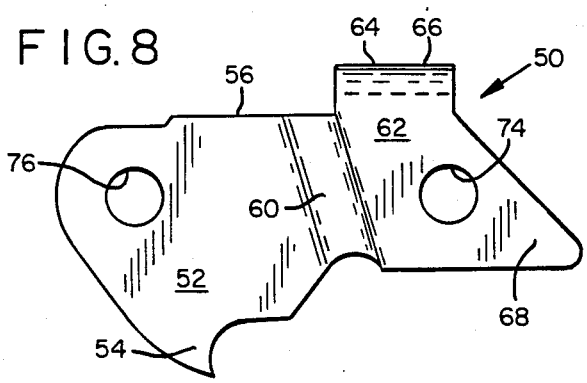
FIG. 8 is a side elevational view of the chain link of FIG. 7.
Figure 10:
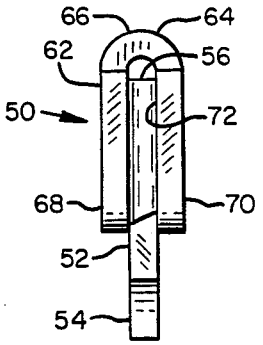
FIG. 10 is a front end view of the chain link of FIG. 7.
Figure 11:
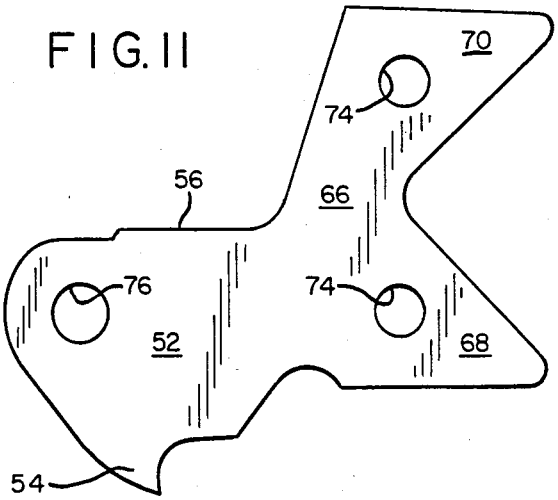
FIG. 11 is a developed pattern from which the chain link of FIG. 7 can be fabricated.

Referring to the drawings and particularly to FIGS. 1–6, my invention is illustrated in the form of a chain link 14 suitable for use in a chain 15 and which includes a first planar portion 16 having a depending sprocket-engageable drive tang 18 and a cutting tooth 20 projecting upwardly from top edge 22. Planar portion 16 has a longitudinal axis 24 which is colinear with the longitudinal axis 25 of chain 15.

A transition portion 26 is disposed forwardly of planar portion 16. Portion 26 is laterally offset from portion 16 and transitions into an adjacent integral second portion 28 which in this embodiment is disposed forwardly of first portion 16 and constitutes the leading portion of the link. Portion 28 is folded over to form a bight 30 which extends upwardly on progressing rearwardly of the link and includes a pair of substantially parallel, laterally-spaced, opposed walls 34, 36 which define a space 38 therebetween. Transition portion 26 is laterally offset an amount equal to the thickness of the material of link 14, whereby axis 24 bisects space 38. In this manner space 38 can receive the first planar portion 16 of a preceding link in the chain.

A pair of aligned rivet-receiving bores or openings 40 extend transversely through walls 34, 36 and a further rivet-receiving bore or opening 42 is provided in portion 16. A single rivet 43 can thus serve to connect the second portion 28 of each link 14 with the first portion 16 of an adjacent link to permit articulation therebetween.

The upward extension of bight 30 provides a sloping depth gauge 32 to limit the cut taken by tooth 20 as link 14 passes through a workpiece. Tang 18 is engageable with the drive sprocket of the chain saw (not shown) to drive the chain.

Referring now to FIGS. 7–11, another embodiment of the invention is illustrated in the form of a chain link 50 which is also suitable for use in chain 15. Link 50 includes a first planar portion 52 having a depending sprocket-engageable drive tang 54, but does not have any cutting tooth on the top edge 56. Link 50 thus serves merely as a combined tie strap and drive link. Again, planar portion 52 has a longitudinal axis 58 which is colinear with the longitudinal axis 25 of chain 15.

A transition portion 60 is disposed forwardly of planar portion 52. Portion 60 is laterally offset from portion 52 and transitions into an adjacent integral second portion 62 which in this embodiment is also disposed forwardly of first portion 52 and constitutes the leading portion of link 50. Portion 62 is folded over to form a bight 64 and includes a pair of substantially parallel, laterally-spaced, opposed walls 68, 70 which define a space 72 therebetween. Transition portion 60 is laterally offset an amount equal to the thickness of the material of link 50, whereby axis 58 bisects space 72. In this manner space 72 can receive the first planar portion 16 of a preceding link.

Again, a pair of aligned rivet-receiving bores or openings 74 extend transversely through walls 68, 70 and a further rivet-receiving bore or opening 76 is provided in portion 52. A single rivet can thus serve to connect the second portion 62 of link 50 with the first portion 16 of an adjacent link to permit articulation therebetween. Tang 54 is engageable with the drive sprocket of the chain saw (not shown) to drive the chain.

As shown in FIG. 1, chain 15 comprises left-hand cutting links 14 and mirror image right-hand cutting links 14a which alternate with tie strap drive links 50. Alternatively, links 14 and **14*a* can be pivotally connected together without links 50 to form a cutting chain, the links 14, 14a** serving as the only elements of the chain.

Also, whereas the cutting tooth 20 of link 14 is illustrated as a typical hollow ground cutting tooth, tooth 20 may, if desired, comprise a top-sharpenable cutter tooth.

Having illustrated and described preferred embodiments of the invention, it should be apparent to those skilled in the art that the invention permits modification in arrangement and detail.

I claim as my invention all such modifications as come within the true spirit and scope of the following appended claims.

1. A chain having a longitudinal axis and comprising at least two articulated links, each link comprising:

a first planar portion having a longitudinal axis colinear with the longitudinal axis of the chain;

a second portion integral with and disposed longitudinally of and adjacent the first planar portion, the second portion being folded over to form a bight having a pair of parallel laterally-spaced opposed walls, the walls defining a space therebetween; and a transition portion disposed between the first and second portions, the transition portion transversely offsetting the second portion with respect to the first portion;

the first planar portion of one of the two links being received within the second folded-over portion of the other of the two links, whereby the longitudinal axis of the first portion of the one link bisects the space between the walls of the second portion of the other link, the first portion of at least the one link including a cutting tooth, the bight immediately preceding the cutting tooth on the one link and defining a depth gauge for said cutting tooth; and pivot means interconnecting the first portion of the one link and the second portion of the other link to permit articulation therebetween.

2. The chain of claim 1, wherein the pivot means comprises a first rivet opening extending transversely through the first planar portion of the one link and a second rivet opening extending transversely through the pair of opposed walls of the second folded over portion of the other link, the first rivet opening in the one link being aligned with the second rivet opening in the other link when the parts are assembled; and a rivet received in the first and second rivet openings to connect the two links together.

3. The chain of claim 1, wherein the first portion of one of the two links comprises a depending sprocket-engageable drive tang.

* * * * *